US008294644B2

(12) United States Patent
Marx et al.

(10) Patent No.: US 8,294,644 B2
(45) Date of Patent: Oct. 23, 2012

(54) CIRCUIT AND CONTROL METHOD FOR A LIGHT-EMITTING DISPLAY

(75) Inventors: Thilo Marx, Villingen-Schwenningen (DE); Heinrich Schemmann, Villingen-Schwenningen (DE)

(73) Assignee: Thomson Licensing, Boulogne Billancourt (FR)

( * ) Notice: Subject to any disclaimer, the term of this patent is extended or adjusted under 35 U.S.C. 154(b) by 981 days.

(21) Appl. No.: 11/579,188

(22) PCT Filed: Apr. 29, 2005

(86) PCT No.: PCT/EP2005/004130

§ 371 (c)(1),
(2), (4) Date: Oct. 31, 2006

(87) PCT Pub. No.: WO2005/109389

PCT Pub. Date: Nov. 17, 2005

(65) Prior Publication Data

US 2008/0030438 A1 Feb. 7, 2008

(30) Foreign Application Priority Data

May 6, 2004 (DE) ..... 10 2004 022 424

(51) Int. Cl.
*G09G 3/32* (2006.01)

(52) U.S. Cl. ..... 345/82; 345/76; 345/83; 345/204; 345/690; 315/169.3; 257/72

(58) Field of Classification Search ..... 345/76–83, 345/690, 204–206, 1.1–960; 315/169.1–169.4; 257/72

See application file for complete search history.

(56) References Cited

U.S. PATENT DOCUMENTS 6,806,497 B2 * 10/2004 Jo ..... 257/59

(Continued)

FOREIGN PATENT DOCUMENTS

EP 1221686 7/2002

(Continued)

OTHER PUBLICATIONS

Search Report Dated Jul. 13, 2005.

(Continued)

*Primary Examiner* — Lun-Yi Lao
*Assistant Examiner* — Kelly B Hegarty
(74) *Attorney, Agent, or Firm* — Robert D. Shedd; Patricia A. Verlangieri

(57) ABSTRACT

A circuit for an element of a light-emitting display is proposed. The element comprises a current control means, first and second switching means and a light-emitting means. In one embodiment, a signal holding means is provided. The arrangement of the first and second switching means of the element makes it possible to measure the electrical parameters of the current control means and of the light-emitting means during operation. A light-emitting display having a plurality of elements is furthermore proposed. The light-emitting display has a control circuit and a memory. The measured values of the electrical parameters of the current control means (4) and of the light-emitting means of the elements are used to correct the control signal S that is used to drive the elements. This enables a uniform brightness distribution in the case of voltage actuation and makes it possible to compensate for temporal changes in the light-emitting means. In addition, a method for actuating the elements and the light-emitting display is proposed.

13 Claims, 6 Drawing Sheets

U.S. PATENT DOCUMENTS

| | | | | |
|---|---|---|---|---|
| 6,917,350 | B2 * | 7/2005 | Pae et al. | 345/55 |
| 6,995,519 | B2 * | 2/2006 | Arnold et al. | 315/169.3 |
| 7,423,617 | B2 * | 9/2008 | Giraldo et al. | 345/82 |
| 2002/0101395 | A1 | 8/2002 | Inukai | |
| 2002/0167471 | A1 * | 11/2002 | Everitt | 345/76 |
| 2003/0062524 | A1 * | 4/2003 | Kimura | 257/72 |
| 2003/0063053 | A1 * | 4/2003 | Yamazaki et al. | 345/82 |
| 2003/0071804 | A1 * | 4/2003 | Yamazaki et al. | 345/204 |
| 2004/0212573 | A1 * | 10/2004 | Sundahl et al. | 345/82 |
| 2005/0012697 | A1 * | 1/2005 | Suzuki | 345/76 |
| 2005/0030267 | A1 * | 2/2005 | Tanghe et al. | 345/82 |

FOREIGN PATENT DOCUMENTS

| | | |
|---|---|---|
| JP | 2003-140611 | 5/2003 |
| JP | 2004-54200 | 2/2004 |
| WO | WO 2004/023446 | 3/2004 |

OTHER PUBLICATIONS

Reiji Hattori, et al., "Circuit Simulation of Poly-Si TFT Based Current-Writing Active Matrix Organic LED Display", Technical Report of IEICE, E2001-8 SDM2001-8 (1002-04), 14 pages.

* cited by examiner

CIRCUIT AND CONTROL METHOD FOR A LIGHT-EMITTING DISPLAY

CROSS-REFERENCE TO RELATED APPLICATIONS

This application claims the benefit, under 35 U.S.C. §365 of International Application PCT/EP2005/004130, filed Apr. 29, 2005, which was published in accordance with PCT Article 21 (2) on Nov. 17, 2005 in English and which claims the benefit of German patent application No. 102004022424.2, filed May 6, 2004.

BACKGROUND OF THE INVENTION

1. Field of the Invention

The invention relates to a circuit for an element of a light-emitting display and to a circuit for a light-emitting display having a plurality of elements. The invention furthermore relates to a method for controlling the elements of a light-emitting display.

2. Description of Related Art

Light-emitting displays, which generate light using light-emitting elements through which an electric current flows, comprise a multiplicity of light-emitting elements in a suitable arrangement. In this case, the light-emitting elements emit a luminous flux that is dependent on the electrical current flowing through them. The term luminous flux describes the total radiation power of the light source. In the following the term current is used to represent the electrical current. In the case of a matrix arrangement comprising a plurality of light-emitting elements, monochromatic or polychromatic images having a plurality of pixels are displayed. In the case of monochromatic images, the images are resolved into individual gray-scale values for the pixels. In this case, the gray-scale values are various luminous flux values. The various luminous flux values are generated by corresponding currents through the light-emitting elements. In the case of a polychromatic light-emitting display, a plurality of light-emitting elements of different colors usually interact. Various colors can be produced from the original colors of the light-emitting elements using additive color mixing for each pixel. The light-emitting elements comprise, inter alia, light-emitting diodes. Light-emitting diodes can be produced on the basis of semiconductive materials (for example silicon, germanium) but light-emitting diodes based on organic materials (OLED: "Organic Light-Emitting Diode") are also available. A common feature of all these light-emitting diodes is that the luminous flux that is output depends on the electrical current through the light-emitting element.

In the case of organic light-emitting diodes (OLEDs), in particular, the current/voltage characteristic curve is greatly dependent on ageing and on process parameters during production.

In organic light-emitting diodes, light is generated by passing a direct current through the organic diode material. In this case, the organic light-emitting diode is forward-biased. It has been found that the forward voltage of the OLED may vary from pixel to pixel and increases over time. It has likewise been found that the current for generating a particular luminous flux remains relatively stable over time.

In today's light-emitting displays comprising light-emitting elements which are arranged in a matrix arrangement and have individual current control means, the individual light-emitting elements are driven successively in lines or columns. FIG. 1 shows a light-emitting element for this type of driving. A current control means 4 is connected in series with a light-emitting element 8 between an operating voltage VDD and ground. A control signal is supplied to a control input of the current control means 4 via a switch 10. In this case, the control signal is a control voltage $U_{Set}$. The switch 10 is controlled in this case in such a manner that only a single light-emitting element in an arrangement of light-emitting elements is respectively driven. In the case of the driving scheme that is required for this circuit, the period of time during which the light-emitting diode radiates light is relatively short. The active period of time is reduced depending on the number of light-emitting elements present in the arrangement of the light-emitting display. Since the human eye is a natural system with a low-pass filter response, it is possible to compensate for the short active period of time by appropriately increasing the luminous flux during the active period of time.

Light-emitting displays in which each current control means is permanently driven by a control signal are also conceivable. The switch 10 can then be dispensed with. However, the multiplicity of requisite control lines reduces the area available for light to emerge on the screen.

In the case of the light-emitting element shown in FIG. 2, a signal holding means 6 has been added to the circuit described above between the control electrode of the current control means 4 and the operating voltage VDD. The control signal $U_{Set}$ applied when the switch 10 is closed is kept constant by the signal holding means 6 when the switch is open until a new control signal $U_{Set}$ is applied. This makes it possible to extend the active period of time during which the light-emitting element 8 radiates light. The active period of time now covers almost the entire period during which an image is composed. This reduces the requisite luminous flux that must be radiated during the active period of time. Since the observer's eye can now integrate a smaller luminous flux over a longer period of time, the same quantity of light is picked up and the same image impression as described with reference to FIG. 1 results. Since ageing and the change in the electrooptical properties of the OLED greatly depend on the current density of the electrical current through the OLED, this circuit offers the advantage of a slower change in the properties.

However, when a control voltage is used for driving, it is generally necessary to take account of the ageing-related change in the forward voltage of the OLED.

Another method for compensating for the time-dependent electrooptical properties involves the driving being carried out using control currents. To this end, a first current control means is connected upstream of each light-emitting element, that is to say each organic light-emitting diode, for example. The first current control means is connected to a second current control means in such a manner that a current mirror circuit results. In the case of the current mirror circuit, a reference current flows through the second current control means, a corresponding control signal becoming established on a control electrode of the second current control means. This control signal is supplied to the control electrode of the first current control means. If the first and second current control means essentially have the same properties, the current through the first current control means corresponds to the current through the second current control means. The same properties of the two current control means compensate for temperature related, production-related and ageing-related changes.

However, the driving method using currents is complex in terms of circuitry and requires a larger number of components than other known methods. The larger number of components in turn reduces the area available for generating light or forms passive regions which do not allow any light to pass through.

The currents used for driving must cover a wide range of values. In particular, the very small electrical currents for small luminous fluxes can be set only in a poorly reproducible manner. In addition, parasitic capacitances, the charge of which must be reversed by the currents, are formed by the connecting lines. When displaying moving images, for example television pictures, the charge is usually reversed 50 to 60 times a second, depending on the television standard used. Even higher image refresh rates are possible for computer monitors. Small control currents may consequently result in reductions in the image quality, whether as a result of delayed image composition, non-uniform image brightness distribution or the like. In addition, the very small currents which are, for example, in the nanoampere range (nA) can be set in a manner that can be reproduced only with great difficulty.

The use of an appropriate current mirror allows the currents required for control and the currents through the light-emitting elements to be selected independently of one another. In this way, it is possible, for example, to increase the currents required for control, while the currents through the light-emitting elements are in an advantageous range. Overall, however, this increases the control power required for driving.

FIG. 3 shows an element of a light-emitting display as was described in FIG. 2. The element is marked by a dashed frame 1. In this case, the control signal S is taken from the control electrode of a current control means 2. When the switch 10 is closed, the current control means 2 forms a current mirror circuit with the current control means 4 of the element 1. In a light-emitting display comprising a plurality of elements 1 in a grid arrangement, an individual control signal is supplied to each element 1 depending on the image content. To this end, a respective control current $i_{prog}$ is forced through the current control means 2. In this case, a control circuit (not shown in FIG. 3) successively actuates the switches 10 of the various elements 1 of the light-emitting display. The increased complexity of the circuit as compared with the circuits in FIGS. 1 and 2 can clearly be seen.

It has been found that, in the case of certain production methods for organic light-emitting diodes, the electrooptical properties of individual light-emitting elements are essentially the same in some regions. In this case, the term electrooptical properties relates to the current/voltage characteristic curve and the associated luminous fluxes. Suitable control of the production methods allows these regions of essentially the same electrooptical properties to be shaped in such a manner that these regions extend over light-emitting elements that are arranged in lines and/or columns. A correction value may thus be provided, during driving, for the respective regions of essentially the same electrooptical properties. However, it is also possible to provide correction values for individual elements. A control signal that has been corrected using the correction value is then used during driving in order to drive the element. This method is particularly suited to being combined with driving of the elements using a control voltage, thus making it possible to use the advantages of voltage driving, for example faster setting of the desired luminous fluxes.

It is now desirable to improve the driving of light-emitting displays having light-emitting elements of the type described above. To this end, it is desirable to obtain an improved element for light-emitting displays. In addition, it is desirable to obtain an improved method for calibrating light-emitting elements and a light-emitting display having light-emitting elements according to the invention.

The element specified in claim 1 achieves part of this object. The light-emitting display specified in claim 8 and the method specified in claim 11 achieve other parts of the object. Further developments of the invention are specified in the respective subclaims.

An element of a light-emitting display according to the invention has a current control means that is connected in series with a light-emitting means. A first switching means is arranged between a control line and a control electrode of the current control means. In a further embodiment, the current control means additionally has an associated signal holding means. When the first switching means is closed, a control signal is applied to the first current control means via the control line. In the case of elements which are arranged in a column and line raster, the first switching means, for example, selects the line in which the element is arranged, while the control line is provided for elements in a column. The current control means controls an electrical current that flows through the light-emitting means. The light-emitting means emits a luminous flux that is dependent on the electrical current. When the luminous flux has been set to a desired magnitude, the first switching means is opened and the next element that is connected to the same control line in a manner such that it can be switched is actuated. In this case, the magnitude of the control signal is corrected in accordance with a correction value that is stored for the respective element or for a group of elements. A memory is provided for individual elements or groups of elements in order to store the correction values. For carrying out the calibration or measurement method described further below, a second switching means is provided, which switchably connects the control line to a connection of the light-emitting means.

Correction is effected in such a manner that the values stored for a group of elements or for individual elements are used to calculate a characteristic curve that describes the electrical properties at various operating points. For the current control means, this may be, for example, a transistor characteristic curve. If the transistor characteristic curve is known, driving may be effected using a voltage that is used to set the desired electrical current. As described further above, the luminous flux output by the light-emitting means is essentially dependent only on the electrical current which flows through the light-emitting means. Driving the current control means using a suitable voltage thus makes it possible to set a desired luminous flux in a reproducible and accurate manner.

However, the circuit according to the invention for the element also makes it possible to measure the electrical properties of the light-emitting means. The electrical properties of those components of an element of a light-emitting display, which are essential for image rendition, can thus be advantageously determined and combined to form a set of correction values.

The circuit of the element allows for redetermining the correction values during a calibration mode or during operation. To this end, a second switching means is connected between the control line and the common circuit point of the first current control means and of the light-emitting means. The control line is connected to means for measuring currents and/or voltages. The electrical properties of the current control means or of the light-emitting means can be determined depending on the switching state of the first and second switching means and of the control line. The properties ascertained are stored in the memory and are used for correction during driving in the abovementioned manner.

In the case of light-emitting displays for rendering large-area images, for example in television sets, the images are produced in non-interlaced or in interlaced format. Non-interlaced or interlaced images are also referred to as "frames" and "fields". In this case, the image area is split virtually and/or physically into lines and/or columns. When rendering images using interlaced images, a partial image that, for example, comprises only the even or only the odd lines of the entire image is then first of all rendered. The other interlaced image is then rendered. In the case of non-interlaced rendition, the entire image is composed. Interlaced rendition is also referred to as "interlaced scan" and non-interlaced rendition is referred to as "progressive scan". When rendering moving images, the non-interlaced or interlaced images are also replaced at regular intervals with respective other images which have an altered image content in order to create the impression of fluid movements as a result. In this case, the image refresh rate is dependent on a respective television standard, for example.

The electrical properties of elements can be measured, for example, between the rendering of two successive interlaced or non-interlaced images. Appropriately switching the first and second switching means makes it possible to bridge the light-emitting means, with the result that no visible interfering effects occur during the measurements.

Driving the elements of the light-emitting display using a control voltage advantageously avoids the effects which result from driving using a control current together with the unavoidable parasitic capacitances. In comparison with current sources, voltage sources have a low impedance and may charge, or reverse the charge of, the parasitic capacitances in a more rapid manner. The setting time for a light-emitting display having elements according to the invention is reduced in comparison with a light-emitting display having conventional elements.

A light-emitting display according to the invention has elements which are arranged in columns and lines. Control lines for the current control means and the switching means are connected to one or more of the elements which are arranged in columns or lines, with the result that each element can be driven. During normal operation, that is to say during operation for the purpose of displaying images by means of the light-emitting display, the control lines are connected to a controllable DC voltage source. When the first switching means are closed, the controllable DC voltage source accordingly sets a control voltage at the control electrode of the current control means.

A light-emitting display having elements according to the invention can also be used, in a particularly advantageous manner, with a control signal that increases continuously from an initial value to a final value. Such a control signal is a sawtooth voltage, for example. In this case, the control signal can be applied to a plurality of elements in a parallel manner. When a voltage that is suitable for the desired luminous flux of an element has been reached, the first switching means associated with the respective element is opened. Using such a signal makes it possible to actuate a plurality of elements in columns and/or lines in a parallel manner. A signal of this type is described in DE-A-103 60 816.

In the case of the invention, the electrical properties of the current control means and of the light-emitting means are known at any point in time. The voltage supply for the light-emitting display can therefore be regulated in such a manner that the maximum voltage needed to generate the desired maximum luminous flux is provided. The requisite voltage increases over time in an ageing-related manner. It is thus possible to save a considerable amount of energy in comparison with a light-emitting display that is designed for a relatively high voltage from the outset and anticipates the ageing effects which are to be expected. In the case of a fixed supply voltage that has been preset at a high value, the excess voltage that is not required for actuation is converted, in the current control means, into heat losses which must be dissipated. The light-emitting display according to the invention thus enables economical operation throughout the entire service life.

The possibility of measuring and storing electrical properties of the components of elements of a light-emitting display during operation also yields advantages for the production of light-emitting displays. Nowadays, the switching and current control means of certain light-emitting displays are usually in the form of so-called thin-film transistors or TFTs and are produced in a first process step. The light-emitting means of certain light-emitting displays are applied in a further process step that is different than the first process step. The arrangement of the first and the second switching means allows the properties of components of the elements already to be measured in an early stage of the production of the light-emitting display. The measured values can then be written to the memory as starting values, with the result that a desired quality of the light-emitting display has already been achieved when the light-emitting display is put into operation for the first time. It is furthermore possible to also physically separate the production steps since the properties are either already stored or can easily be ascertained by measurement. Should the first measurements indicate faults as early as in individual process steps before completion of the light-emitting display, faulty parts can be identified in good time and further process steps can be stopped. The use of resources can thus be reduced.

BRIEF SUMMARY OF THE INVENTION

In carrying out an inventive feature, a light-emitting display has a plurality of elements, each element including a light-emitting means. A control line is switchably connected to means for measuring a current in a current control means, to means for measuring a voltage developed in the light emitting means and to means for applying a DC voltage to a control electrode of the current control means.

DETAILED DESCRIPTION OF THE INVENTION

In the figures, identical or similar components and elements are provided with identical reference symbols.

Figure 1:
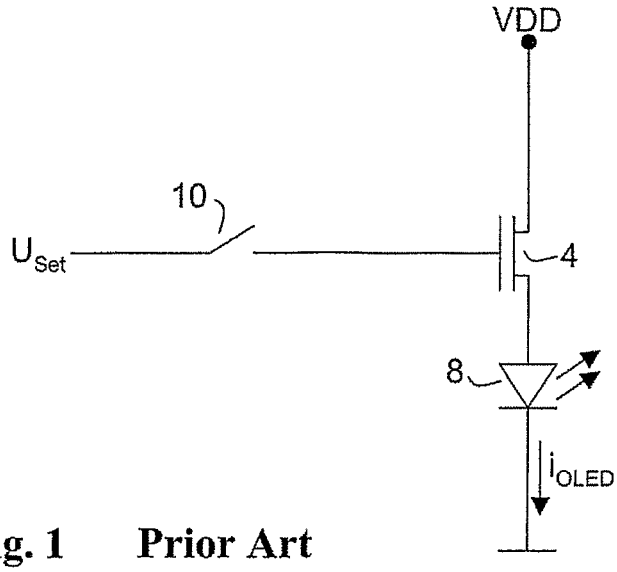
Fig. 1 Prior Art
FIG. 1 shows a circuit for an element of a light-emitting display as is known from the prior art.
Figure 2:
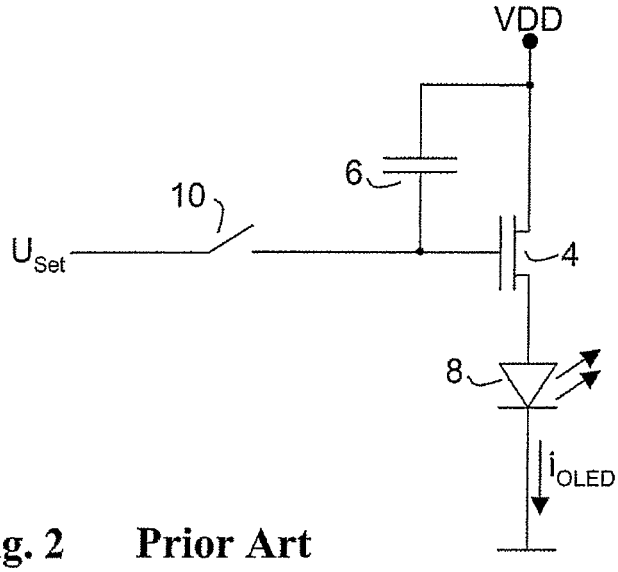
Fig. 2 Prior Art
FIG. 2 shows a further known circuit for an element of a light-emitting display.
Figure 3:
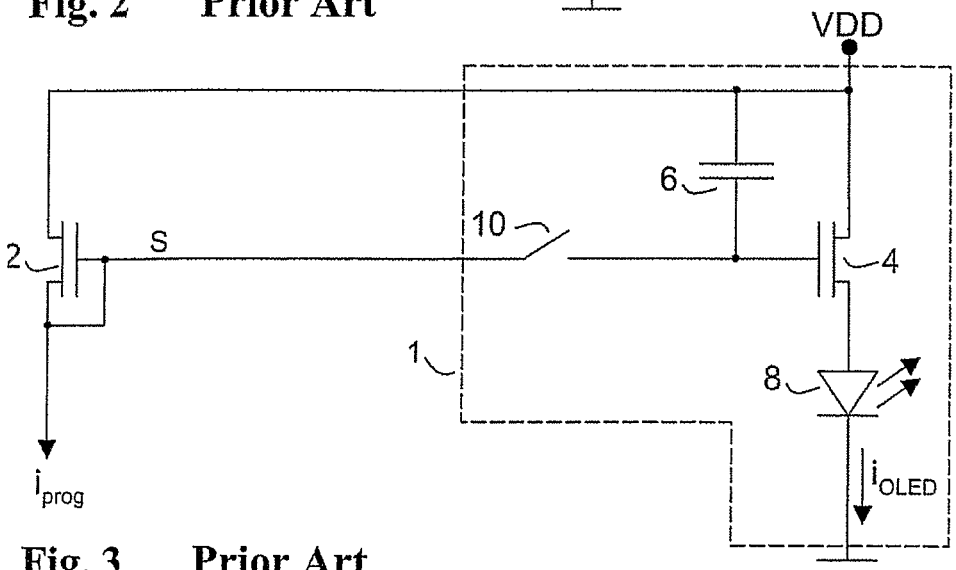
Fig. 3 Prior Art
FIG. 3 shows a third known circuit for an element of a light-emitting display.

FIGS. 1 to 3 have already been described further above in the introduction to the description. They will not be explained in any more detail below.

Figure 4:
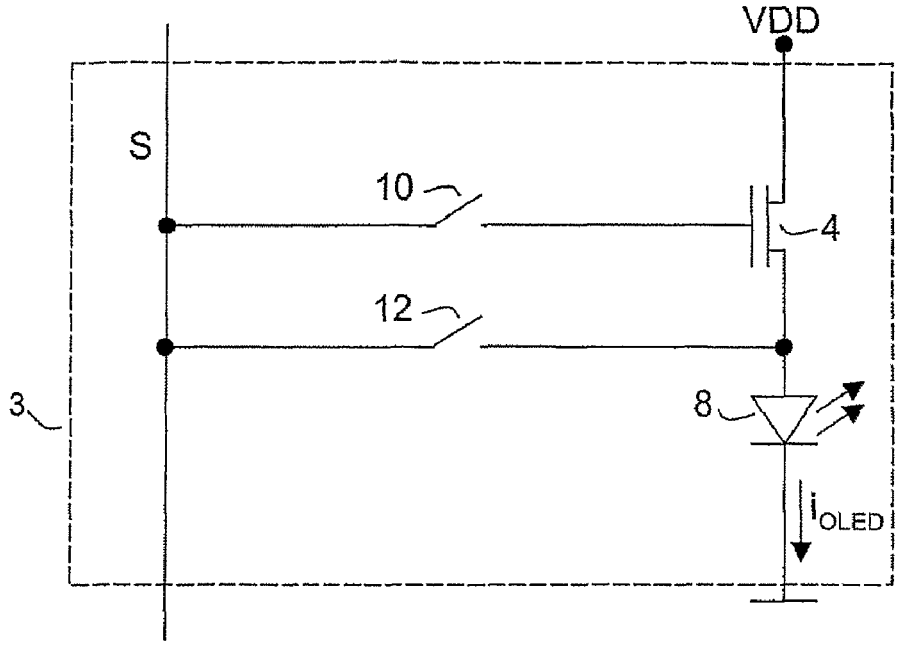
FIG. 4 shows a schematic illustration of a first embodiment of a circuit according to the invention for an element of a light-emitting display.

FIG. 4 schematically shows one embodiment of an element according to the invention of a light-emitting display. One connection of a current control means 4 is connected to an operating voltage VDD. A further connection of the current control means 4 is connected to a first connection of a light-emitting means 8. A second connection of the light-emitting means 8 is connected to a reference potential. The reference potential may be ground, for example, as shown in the figure. The current control means 4 is, for example, a transistor. In the present exemplary embodiment, the light-emitting means 8 is a light-emitting diode but the invention is not restricted to the use of light-emitting diodes. All light-emitting means which can be unambiguously described using a characteristic curve of electrical current to luminous flux can be used within the scope of the invention. A first switching means 10 is used to switchably connect a control electrode of the current control means 4 to a control line S. The control line S can be used to apply a control signal, for example a control voltage, to the control electrode. The dashed frame 3 indicates that the components described above form an element of a light-emitting display in accordance with the invention. Furthermore, a second switching means 12 is used to switchably connect a common connection of the current control means 4 and of the light-emitting means 8 to the control line S. The control line S can furthermore be connected to means (not shown in the figure) for measuring voltages and/or currents.

Figure 5:
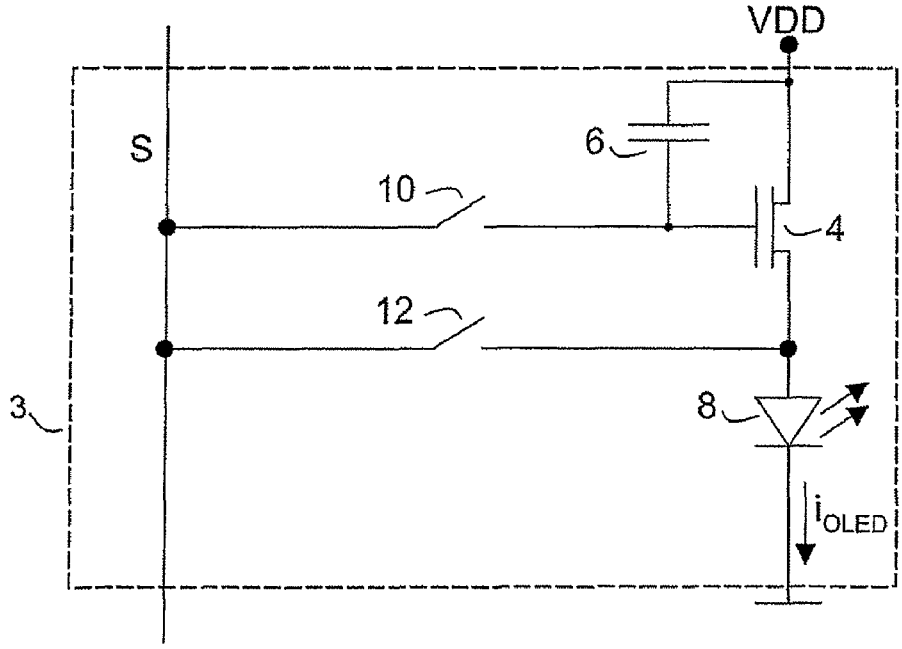
FIG. 5 shows a schematic illustration of a second embodiment of an element according to the invention of a light-emitting display.

FIG. 5 shows a further embodiment of the element 3 of a light-emitting display, which, in comparison with the embodiment in FIG. 4, has been supplemented by a signal holding means 6. The signal that has been applied to the control electrode of the current control means 4 is held by the signal holding means 6 when the first switching means 10 is open. The signal holding means 6 is, for example, a capacitor. As described further above, the signal holding means can be used to extend the active time of the element, that is to say the time during which the light-emitting means is illuminated. The peak current loading on the light-emitting means can thus be reduced.

Figure 6:
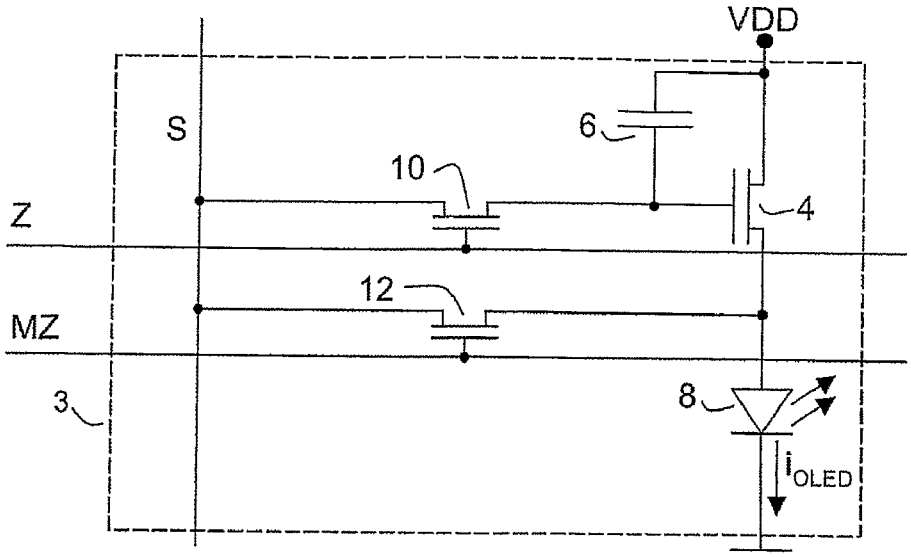
FIG. 6 shows a specific embodiment of an element according to the invention of a light-emitting display.

FIG. 6 shows a specific exemplary embodiment of an element 3 according to the invention of a light-emitting display. In comparison with FIG. 5, the first and the second switching means (10, 12) are formed by transistors. The first and the second switching means (10, 12) are controlled by means of control lines Z and MZ, respectively.

Figure 7:
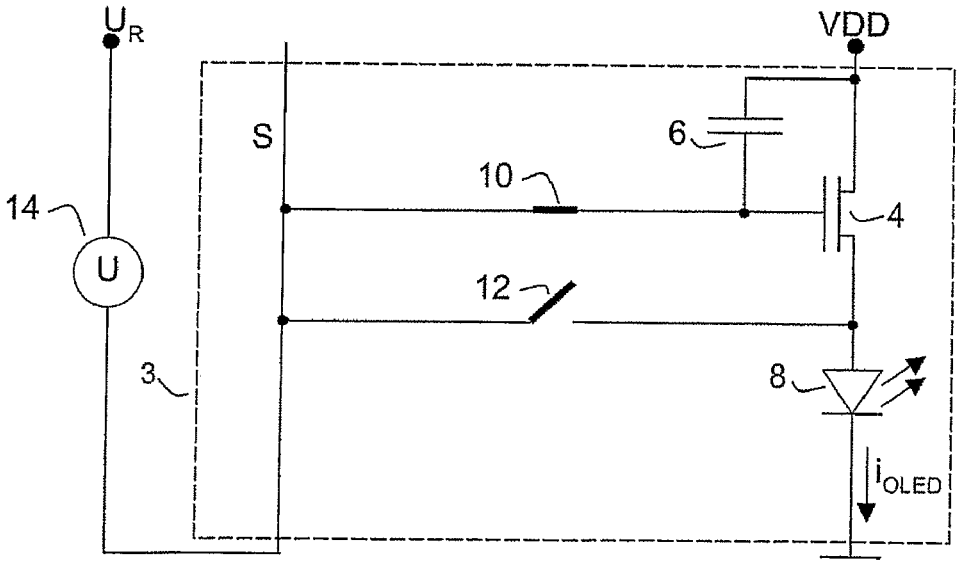
FIG. 7 shows the circuit of the element of a light-emitting display according to the invention in a first operating mode.

FIG. 7 shows an element 3 according to the invention of a light-emitting display in a first operating mode. A voltage source 14 is connected to the control electrode of the current control means 4 via the closed first switching means 10 and the control line S. The voltage source is related to a reference voltage $U_R$. The reference voltage $U_R$ may, for example, be the supply voltage or ground. A further connection of the control line S is shown as not being connected. In this case, further elements 3 or means for measuring currents or voltages, for example, are switchably connected. The signal holding means stores the control signal and, as soon as the desired control signal is applied to the control electrode of the current control means 4, the first switching means 10 can be opened again. Afterwards, the same control line S can be used to drive a further element 3 of a light-emitting display. Driving may be effected cyclically element by element, with the result that the image contents of a light-emitting display comprising elements according to the invention can be changed.

Figure 8:
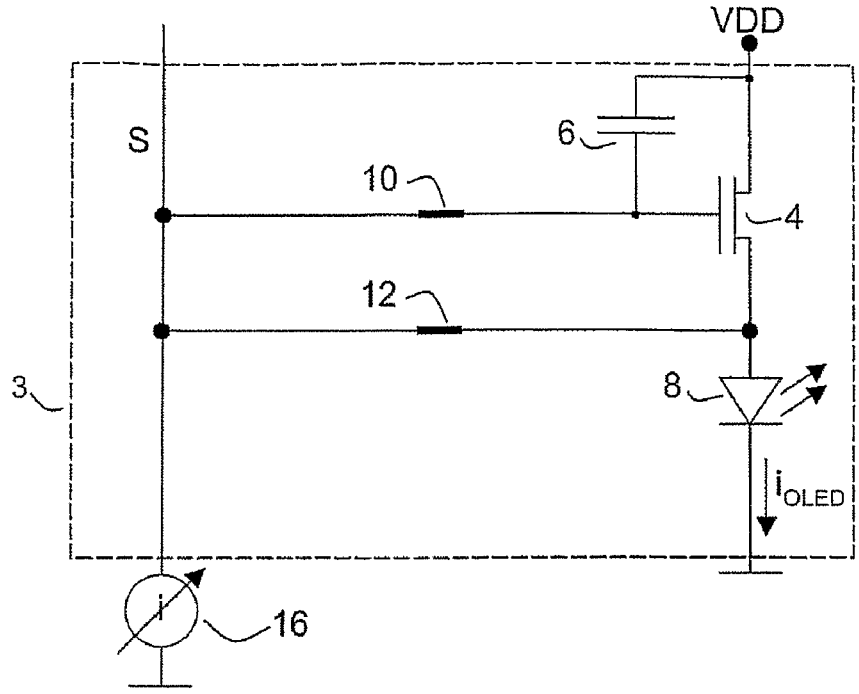
FIG. 8 shows the circuit of the element of a light-emitting display according to the invention in a second operating mode.

FIG. 8 shows an element 3 according to the invention of a light-emitting display in a second operating mode. The first and second switching means 10 and 12 are closed. The current control means 4 is of such a nature that it is fully turned on when the potential at the control electrode is lower than the potential at a first current-carrying connection. In addition, said current control means is of such a nature that essentially no current flows via the control electrode. The first current-carrying connection of the current control means 4 is connected to a supply voltage VDD. The control line S is connected to a reference potential via a means 16 for measuring electrical currents. The reference potential is lower than the potential at the first current-carrying connection, for example ground potential. The current control means 4 is thus fully turned on. The light-emitting means 8 is bridged to the reference potential via the closed second switching means 12 and the control line. In this circuit configuration, it is possible to measure the short-circuit current of the current control means 4. The short-circuit current is needed to calculate the characteristic curve of the current control means 4 and is stored in a memory (not shown) that is associated with the element.

Figure 9:
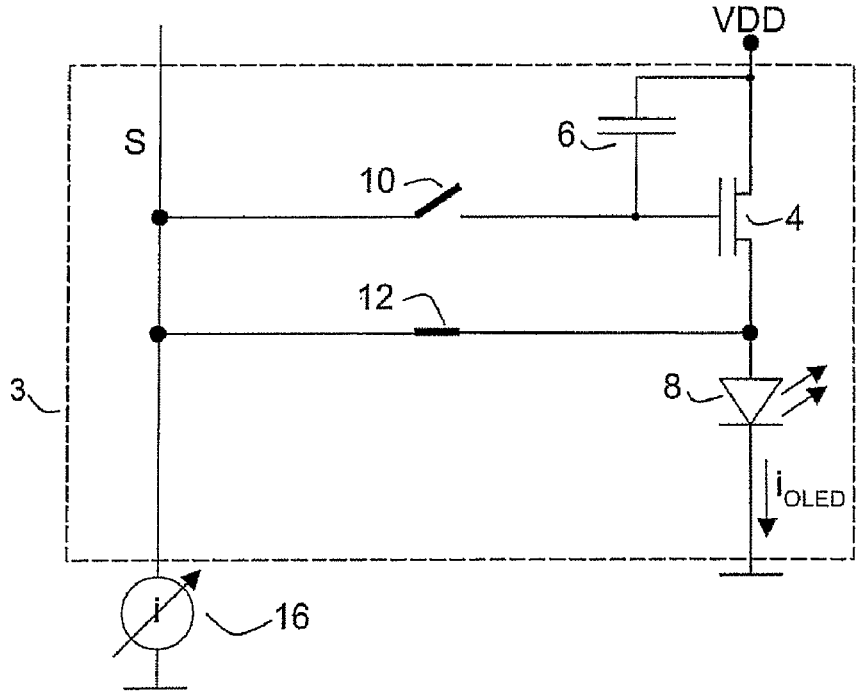
FIG. 9 shows the circuit of the element of a light-emitting display according to the invention in a third operating mode.

FIG. 9 shows an element 3 according to the invention of a light-emitting display in a third operating mode. In this operating mode, a signal has first of all been stored in the signal holding means 6, as described with reference to FIG. 7. The first switching means 10 is open and a predetermined current flows through the current control means and the light-emitting means. The second switching means 12 is closed and connects the common circuit point of the current control means 4 and of the light-emitting means 8 to the control line S. The control line S is connected to a reference potential via a means 16 for measuring electrical currents. In this operating mode, it is possible to measure the electrical properties of the current control means 4 at a particular known current or a particular known control voltage. The measured values are stored and are used to determine the characteristic curve of the current control means 4. A plurality of measurements in this operating mode for different currents can be used to acquire the entire characteristic curve of the current control means 4. If the current control means 4 is a field effect transistor, the threshold voltage of the transistor can also be determined. The third operating mode can be set, for example, during normal operation. The measurements can then be carried out, for example, in the time between two successive interlaced or non-interlaced displays. Since the current control means 4 operates as a current source, the current through the control line S and the means 16 for measuring electrical currents when the second switching means 12 is closed is of exactly the same magnitude as the current through the light-emitting means 8 when the second switching means 12 is open.

In a further development (not shown in the figures) of the circuit in FIG. 8 or 9, the light-emitting means 8 is not fixedly connected to the reference potential but rather is switchably connected to a connection network. When the connection network is disconnected, it is thus ensured that no current flows through the light-emitting elements 8 during the measurements. In the case of light-emitting elements which have a diode characteristic, it is possible, instead of disconnecting the connection network, to connect it to a higher potential, for example the operating voltage VDD. A circuit of this type makes it possible to avoid parasitic effects during the measurements, which effects are caused by the light-emitting elements. The measurement accuracy is improved because no parallel currents can flow through the light-emitting means. In addition, it is no longer necessary to allow the measurement current to flow to the potential of the cathode connection of the light-emitting means.

Figure 10:
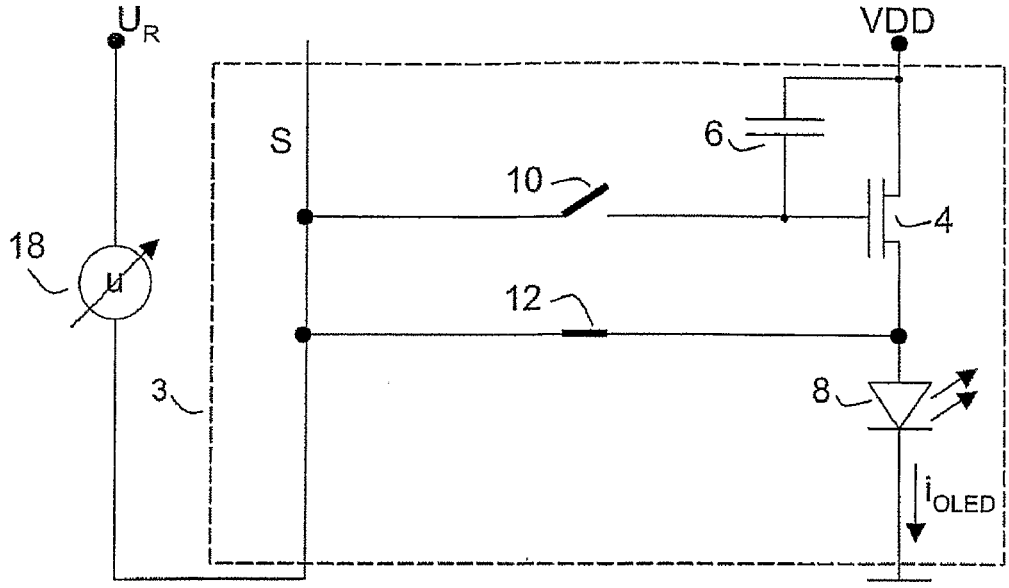
FIG. 10 shows the circuit of the element of a light-emitting display according to the invention in a fourth operating mode.

FIG. 10 shows an element 3 according to the invention of a light-emitting display in a fourth operating mode. As explained above in the description relating to FIG. 9, a signal has first of all been stored in the signal holding means 6. The first switching means 10 is open and a current flows through the current control means 4 and the light-emitting means 8. The second switching means 12 is closed and connects the common circuit point of the current control means 4 and of the light-emitting means 8 to the control line S. The control line S is connected to a means 18 for measuring electrical voltages. In this operating mode, it is possible to determine the electrical properties of the light-emitting means 8. Repeated measurements for different currents also make it possible in this case to acquire the entire characteristic curve of the light-emitting means 8. In addition, it is possible to ascertain changes in the electrical properties of the light-emitting means 8 as a result of ageing effects and to correspondingly adapt or correct driving. The measured values are stored in a memory (not shown) that is associated with the element and are used to correct the driving signal.

If the maximum voltage of all light-emitting means of the light-emitting display is known, which maximum voltage is needed to achieve a desired maximum luminous flux, the supply voltage can be reduced to this value in order to save energy. This can be effected for the entire light-emitting display or for individual elements or groups of elements. Setting the supply voltage for groups of elements or individual elements makes it possible to minimize the energy required for operation.

Figure 11:
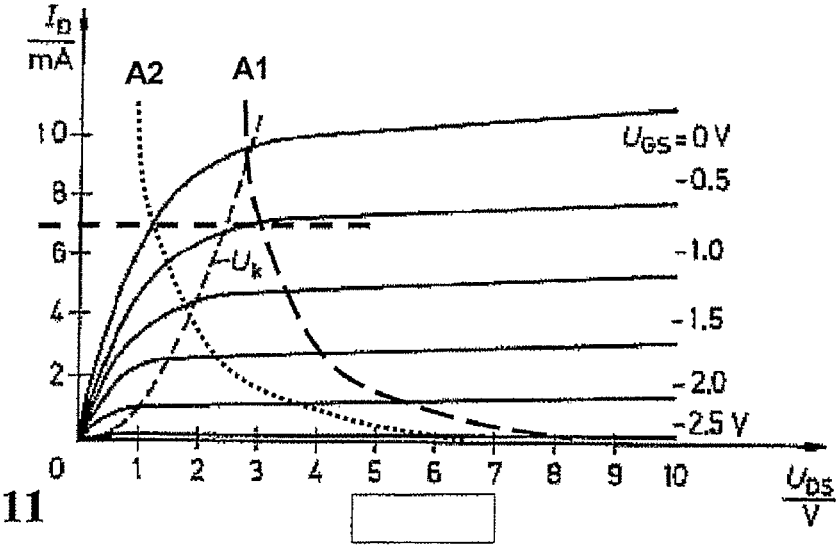
FIG. 11 shows an exemplary transistor characteristic curve having operating points.

FIG. 11 shows an exemplary family of characteristic curves of a transistor. If the family of characteristic curves of the current control means 4 of the light-emitting display is known, the operating point of the current control means 4 can be moved to the non-linear range, as a result of which the operating voltage can be reduced further. The characteristic curve A1 is an exemplary characteristic curve of a light-emitting means 8. If the transistor is operated in the linear range, a gate voltage $U_{GS}$ of −0.5 V at a drain-source voltage $U_{DS}$ of at least 3 V is required for a current of 7 mA. In the case of a known transistor characteristic curve, the operating point can be shifted to the non-linear range, shown by the characteristic curve A2 in the figure. Given a higher gate voltage $U_{GS}$, only a drain-source voltage $U_{DS}$ of approximately 1 V is required for a current of 7 mA. The associated reduction in the operating voltage VDD reduces the heat losses of the light-emitting display. The values in this figure have been selected merely by way of example and may, in practice, differ. However, the principle is generally applicable.

Figure 12:
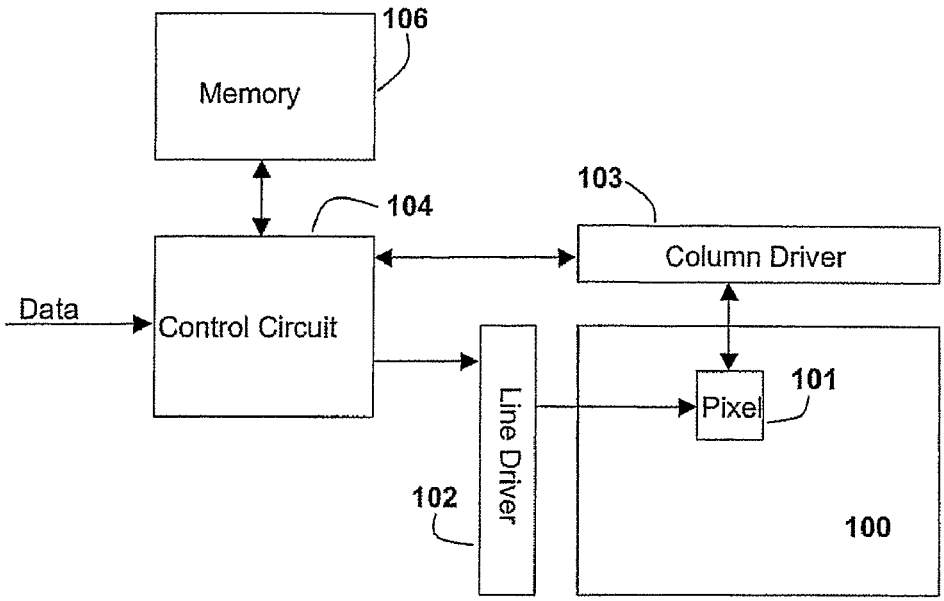
FIG. 12 shows a diagrammatic block diagram of a light-emitting display according to the invention.

FIG. 12 shows a diagrammatic block diagram of a light-emitting display according to the invention. A light-emitting display 100 has a multiplicity of pixels 101. The pixels 101 correspond to the elements 3 described above. In the case of light-emitting displays for rendering colored images, the pixels 101 comprise groups of a plurality of elements 3 for rendering respectively different colors, for example the primary colors red, green and blue for additive color mixing. Other color combinations are conceivable depending on the desired impression. In both cases, groups of corresponding elements 3 of a pixel are to be driven in such a manner that the desired color is produced for each pixel by means of color mixing. The figure shows only one pixel 101 as representative of the multiplicity of pixels. The pixels 101 are connected to line drivers 102 and column drivers 103. The line drivers 102 apply control signals to the control lines Z and MZ (not shown in the figure). The column drivers 103 are connected to the control line S. In addition, the column drivers 103 can connect the control line S to means for measuring the voltage and/or current. A control circuit 104 is provided for the purpose of controlling the line and column drivers 102, 103. The control circuit 104 is furthermore connected to a memory 106 that stores measured values in such a manner that they can be read out. During operation, the control circuit 104 receives data for an image that is to be displayed and corrects the data for individual pixels or groups of pixels on the basis of the characteristic curves—stored in the memory 106—of the current control means 4 and/or of the light-emitting means 8.

Figure 13:
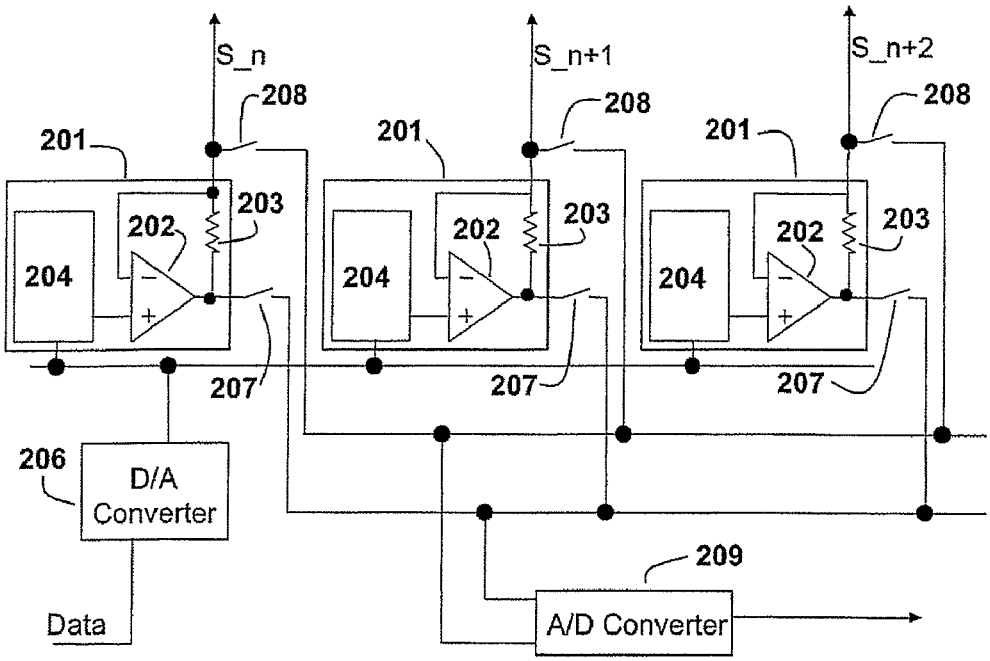
FIG. 13 shows an exemplary embodiment of a column or line driver.

FIG. 13 schematically shows part of an exemplary column driver. Control lines S_n, S_n+1 and S_n+2 are connected to means for measuring the current and for applying a control signal 201. The means for measuring the current and for applying a control signal 201 comprise sample-and-hold elements 204, operational amplifiers 202 and current-limiting means 203. The current-limiting means 203 are, for example, resistors. In the first operating mode, a data value is converted to a voltage value by means of a digital/analog converter 206 and is supplied to one or more means for measuring the current and for applying a control signal 201. The voltage value is held in sample-and-hold elements 204 and is supplied to the control lines via the operational amplifiers 202 and the current-limiting means 203. The control lines S_n are connected to elements 3 or pixels 101 (not shown in the figure). In another operating mode, it is possible to measure the current through the control lines S_n. To this end, switching means 207 and 208 are closed. The closed switching means 207 and 208 connect the current-limiting means 203 to an analog/digital converter 209 in such a manner that it is possible to measure the currents in the control lines. In this case, the connection network that is connected to the switching means 207 is connected to a reference potential. If only the switching means 208 is closed and one input of the analog/digital converter is connected to a reference potential, it is possible to measure the voltage of the control line.

To assist understanding, FIG. 13 shows only some control lines and connected circuit parts. Furthermore, not all possible switching means and their states are shown. For the purposes of the invention, other means for measuring the current and voltage can also be used, it being possible for the latter to also be connected to the control lines S_n in another manner. The element according to the invention of a light-emitting display is not restricted to the use with one of the circuits shown.

It is also possible for only one control signal to be generated and to be applied to the individual control lines S_n via a multiplexer, for example. The elements 3 or pixels 101 are then driven, for example, in columns or lines in a sequential manner rather than in columns or lines in a parallel manner.

The circuits described above for elements of light-emitting displays, the light-emitting displays and the associated method and its modifications are not only suited to sequentially actuating lines or columns. A line interlacing method can also be used for actuation. This advantageously results in compatibility with existing standards for image transmission, with no partial images being buffer-stored. Further particular actuation patterns are conceivable, for example with columns or the like actuated simultaneously from both sides toward the center.

The embodiments of the current control means 4 of the circuit described above with reference to the figures are designed using p-channel field effect transistors. However, it is also possible for the circuits to be designed using n-channel field effect transistors. The control signal and the arrangement of the signal holding means 6 and of the light-emitting means 8 relative to the current control means then need to be adapted in a known manner.

The use of field effect transistors for the current control means 4 is advantageous when the signal holding means 6 is a capacitor, for example. If no signal holding means 6 of this type are provided, it is also conceivable to use bipolar transistors.

In the embodiments described above, transistors have been used for the switching means 10, 12, in which case both bipolar transistors and field effect transistors can be used for switching. However, the circuit according to the invention is not restricted to transistors as switches. It is also conceivable to use mechanical, micromechanical, magnetic or optical switches.

In principle, the circuit and the method are suitable for any desired light-emitting means whose luminous flux can be unambiguously controlled using a current. The invention is not restricted to the OLEDs or light-emitting diodes (LEDs) mentioned in the description of the embodiments.

The advantages of the invention were described, in particular, with regard to actuation using control voltages. However, the invention also affords advantages for actuation using control currents.

The invention claimed is:

1. A light-emitting display having a plurality of elements, each element including a light-emitting means that emits light when a current flows through it, having a current control means arranged in a non-current mirror configuration that is connected in series with the light-emitting means, a control line being connected to a control electrode of the current control means via a first switching means that is controlled by a first switching signal, wherein a signal holding means is connected to the control electrode of the current control means in such a manner that a control signal that is applied to the control electrode of the current control means is maintained when the first switching means interrupts the connection between the control line and the control electrode of the current control means, wherein the control line is connected to a common circuit point of the current control means and of the light-emitting means via a single second switching means that is controlled by a second switching signal, wherein a control circuit is provided for controlling the first and the second switching means, wherein the control line is switchably connected to means for measuring a current in said current control means, to means for measuring a voltage developed in said light emitting means and to means for applying a DC voltage to said control electrode of said current control means, wherein the elements have an associated memory that stores measured values in a retrievable manner, wherein the control circuit is adapted to provide a first operating mode, in which a control voltage is applied to the control electrode of the current control means of an element via the first switching means, in which the means for measuring the current are connected, via the second switching means and the control line, to the common circuit point of the current control means and of the light-emitting means of the element, for measuring the current corresponding to the control voltage, and in which a plurality of measurements is carried out for different control voltages and corresponding currents, wherein the plurality of measured values are stored in the memory associated with the element.

2. The light emitting display as claimed in claim 1, wherein the control circuit retrieves and evaluates previously stored measured electrical parameters and applies, to one or more elements, a control signal that is generated using the stored electrical parameters via the control line.

3. The light-emitting display of claim 1, wherein the elements are arranged in lines and/or columns.

4. The light-emitting display as claimed in claim 3, wherein the control line is connected to a plurality of elements in a line and/or a column.

5. The light-emitting display as claimed in claim 4, wherein a common first and a common second switching signal, respectively, are supplied to a plurality of respective first and second switching means of elements in a line or a column.

6. A method of operating a light-emitting display having a plurality of elements, each element including a light-emitting means that emits light when a current flows through it, a current control means arranged in a non-current mirror configuration that is connected in series with the light-emitting means, a control line being connected to a control electrode of the current control means via a first switching means that is controlled by a first switching signal, wherein a signal holding means is connected to the control electrode of the current control means in such a manner that a control signal that is applied to the control electrode of the current control means is maintained when the first switching means interrupts the connection between the control line and the control electrode of the current control means, wherein the control line is connected to a common circuit point of the current control means and of the light-emitting means via a single second switching means that is controlled by a second switching signal, and wherein the control line is switchably connected to means for measuring a current in said current control means, to means for measuring a voltage developed in said light emitting means and to means for applying a DC voltage to said control electrode of said current control means, respectively, the method including, in a first operating mode, the steps of:

closing the first switching means in response to the first switching signal;

storing a predetermined control voltage in the signal holding means of the current control means, the predetermined control voltage corresponding to a desired luminous flux;

opening the first switching means in response to the first switching signal;

closing the second switching means in response to the second switching signal;

connecting the control line to a reference potential via means for measuring a voltage;

measuring the voltage at the common circuit node of the light emitting means and the current control means;

storing the measured voltage value in the memory; and opening the second switching means in response to the second switching signal.

7. The method as claimed in claim 6, wherein the measurement is carried out repeatedly for various predetermined values of the control voltage.

8. The method as claimed in claim 6, further including the step of supplying the measured electrical parameters to the control circuit, the control circuit using the measured electrical parameters to calculate a family of characteristic curves of the first current control means.

9. The method as claimed in claim 6, further including the step of setting a supply voltage for individual elements or groups of elements of the light-emitting display in a manner dependent on the measured electrical parameters of the individual components or groups of components to a value sufficient for achieving a desired maximum electrical current through the element or group of elements.

10. The method of claim 6, further including, in a second operating mode, the steps of:

closing the first switching means in response to the first switching signal;

storing a predetermined control voltage in the signal holding means of the current control means, the predetermined control voltage corresponding to a desired luminous flux;

opening the first switching means in response to the first switching signal;

closing the second switching means in response to the second switching signal;

measuring a current flowing through the current control means corresponding to the applied control voltage, through the control line and the closed second switching means;

storing the measured current value in the memory in a retrievable manner; and opening the second switching means in response to the second switching signal.

11. The method as claimed in claim 10, wherein the measurement is carried out repeatedly for various predetermined values of the control voltage.

12. The method as claimed in claim 10, further including the step of supplying the measured electrical parameters to the control circuit, the control circuit using the measured electrical parameters to calculate a family of characteristic curves of the first current control means.

13. The method as claimed in claim 10, further including the step of setting a supply voltage for individual elements or groups of elements of the light-emitting display in a manner dependent on the measured electrical parameters of the individual components or groups of components to a value sufficient for achieving a desired maximum electrical-current through the element or group of elements.

* * * * *